US011129769B2

(12) United States Patent
Chang et al.

(10) Patent No.: US 11,129,769 B2
(45) Date of Patent: Sep. 28, 2021

(54) METHOD FOR MEASURING STROKES OF CPR AND SYSTEM USING THE SAME

(71) Applicant: SANTCHAN CO., LTD., Taipei (TW)

(72) Inventors: Yi-Chung Chang, Taipei (TW); Li-Chung Chang, Taipei (TW)

(73) Assignee: SANTCHAN CO., LTD., Taipei (TW)

( * ) Notice: Subject to any disclaimer, the term of this patent is extended or adjusted under 35 U.S.C. 154(b) by 628 days.

(21) Appl. No.: 16/123,000

(22) Filed: Sep. 6, 2018

(65) Prior Publication Data

US 2020/0078262 A1 Mar. 12, 2020

(51) Int. Cl.
*A61H 31/00* (2006.01)

(52) U.S. Cl.
CPC ..... *A61H 31/005* (2013.01); *A61H 31/007* (2013.01); *A61H 2201/501* (2013.01); *A61H 2201/5023* (2013.01); *A61H 2201/5084* (2013.01)

(58) Field of Classification Search
CPC .. A61H 31/004; A61H 31/005; A61H 31/007; A61H 2031/001; A61H 2031/002; A61H 2031/003; A61H 2201/501; A61H 2201/5023; A61H 2201/5084; A61H 2201/5061; A61H 2201/5064; G09B 23/288; G09B 23/30; A61B 5/1126
See application file for complete search history.

(56) References Cited

U.S. PATENT DOCUMENTS

2004/0082888 A1* 4/2004 Palazzolo ..... A61B 5/721 601/41
2010/0022904 A1* 1/2010 Centen ..... G09B 23/288 600/534
2016/0279405 A1* 9/2016 Riley ..... A61N 1/046

* cited by examiner

*Primary Examiner* — Samchuan C Yao
*Assistant Examiner* — Cana A Gallegos
(74) *Attorney, Agent, or Firm* — WPAT, PC

(57) ABSTRACT

A method for measuring strokes of CPR and a system using the method are disclosed. The system includes at least one permanent magnet and stroke detecting device which has a magnetic sensor, an accelerometer, a CPR detector, a controller, a power unit, and a housing. The system can measure strokes of CPR without a detector making patients uncomfortable. Meanwhile, the system is tiny and can be used to cooperate with AED.

18 Claims, 8 Drawing Sheets

METHOD FOR MEASURING STROKES OF CPR AND SYSTEM USING THE SAME

FIELD OF THE INVENTION

The present invention relates to an auxiliary method for Cardiopulmonary Resuscitation (CPR) and a system using the method. More particularly, the present invention relates to a method for measuring strokes of CPR and a system using the method.

BACKGROUND OF THE INVENTION

CPR is an emergency procedure which combines chest compressions often with artificial ventilation. It is in an effort to manually preserve intact brain function until further measures are taken to restore spontaneous blood circulation and breathing in a person who is in cardiac arrest. According to regulations in most countries, depth of chest compression in CPR (hereinafter referred as stroke), for example, for adults, should be at least 2 in. (5 centimeters). A rate of the stroke is at least 100 to 120 per minute. Stroke to breathing ratios is set at 30 to 2. Due to the emergency situations, CPR usually takes tens of minutes. It is a huge physical load for rescuers. Once the rescuers cannot sustain the load, the strokes may not meet required extent. Thus, CPR may fail and victims may further in a dangerous situation.

In order to remind the rescuers of correct strokes, there are many prior arts providing associated solutions. For example, U.S. Pat. No. 8,096,962 discloses a method of determining strokes during CPR. The method processes a raw acceleration signal, which is measured by an accelerometer-based compression monitor, to produce an estimated actual stroke. The raw acceleration signal is filtered during integration and then a moving average of past starting points estimates the actual current starting point. An estimated actual peak of the compression is then determined in a similar fashion. The estimated actual starting point is subtracted from the estimated actual peak to calculate the estimated actual strokes. In addition, one or more reference sensors may be used to help establish the starting points of compressions. Although '962 provides a direct and simple way to calculate the actual strokes, however, in practice, noises of the acceleration signal significantly reduces the accuracy of estimation for the strokes.

In another prior art, U.S. Pat. No. 8,951,213, a chest compression monitor for measuring the strokes achieved during CPR is disclosed. The monitor uses a sensor disposed within its housing so that compression of the housing due to CPR compressions with its resultant deformation can be detected by the sensor and used by the control system as the starting point for calculating chest compression depth based on an acceleration signal indicative of the downward displacement of the chest. The monitor may provide data of chest compression depth more precise than that come from the method in '962. However, the housing of the monitor is so large that it would cause uncomfortable feeling to the victim. Meanwhile, the rescuer would also feel it is not easy to perform CPR.

US patent application No. 2015/0087919 discloses an emergency medical services smart watch. Worn with the emergency medical services smart watch, strokes the CPR provider dose can be available immediately and shown on a display. The problem left in '213 can be solved since said monitor can be shrunk in size and becomes a watch for the CPR provider to wear. However, the emergency medical services smart watch is a standalone device and users still need to train before performing CPR with it. Readings or alerts from the emergency medical services smart watch may not easily be noticed by the CPR provider. Furthermore, CPR often comes with Automated External Defibrillator (AED). If possible, functions of the emergency medical services smart watch are better integrated with an AED for ordinary people to carry out.

From the review of prior arts above, it is to know that current methods for measuring strokes of CPR is still challenged by accuracy while associated devices need to be smart and small enough for use and cooperated with AED. Thus, a method for measuring strokes of CPR and a system using the method are provided by the present invention to fulfill the requirements above.

SUMMARY OF THE INVENTION

This paragraph extracts and compiles some features of the present invention; other features will be disclosed in the follow-up paragraphs. It is intended to cover various modifications and similar arrangements included within the spirit and scope of the appended claims.

According to an aspect of the present invention, a method for measuring strokes of CPR, comprises the steps of: a) providing at least one permanent magnet on reference position(s) of a chest of a patient and a magnetic sensor and an accelerometer on a hand position where a rescuer performing CPR, wherein the magnetic sensor measures magnetic values in a magnetic field formed by the at least one permanent, and the accelerometer measures acceleration along the direction of stroke with time at where it is located; b) recording magnetic values from the magnetic sensor and acceleration values from the accelerometer with an equal time interval between any two adjacent time points when CPR is carried out; c) obtaining calibrated velocities of the accelerometer at all time points from the magnetic values and the acceleration values; d) obtaining calibrated positions of the accelerometer at all time points from the magnetic values and the calibrated velocities; e) repeating to process step c) and step d) until a CPR starting time point is determined by a CPR detector; f) calculating the stroke of CPR at all time points by deducting the calibrated position at the CPR starting time point from all calibrated positions; and g) processing step c), step d) and step f).

Preferably, the step c) may be achieved by the sub-steps of: c1) accumulating products of the acceleration value and the time interval with time to obtain reference velocities at all time points; c2) finding out first time points when relative extrema of the magnetic values happened; c3) finding out first reference velocities at the first time points; c4) processing a statistical analysis on the first reference velocities to obtain a velocity offset for each reference velocity; and c5) deducting the velocity offset from corresponding reference velocity to obtain a calibrated velocity of the accelerometer for all time points. The statistical analysis may be a linear regression analysis or a nonlinear regression analysis.

Preferably, the step d) may be achieved by the sub-steps of: d1) accumulating products of the calibrated velocity and the time interval with time to obtain reference positions at all time points; d2) finding out second time points when an assigned magnetic value was approached or happened; d3) finding out first reference locations at the second time points; d4) processing a statistical analysis on the first reference locations to obtain a location offset for each reference position; and d5) deducting the location offset from corresponding reference position to obtain a calibrated position of the accelerometer for all time points. The statistical analysis may be a linear regression analysis or a nonlinear regression analysis.

In one embodiment, the method may further comprise steps between the step d) and the step e): d6) pairing each magnetic value with one corresponding calibrated position at the same time point; d7) processing a statistical analysis on the pairs to obtain a regression relationship between the magnetic values and the calibrated positions; and d8) replacing the calibrated positions with the ones from the regression relationship by inputting the magnetic values for the same time point. The statistical analysis may be a linear regression analysis or a nonlinear regression analysis.

Preferably, the at least one permanent magnet may be thin powerful magnet. The thin powerful magnet may be a neodymium magnet or an electromagnet. If there are two permanent magnets, they may be placed on the reference positions with the direction of S-pole-to-N-pole is substantially perpendicular to the surface of the chest of the patient.

According to another aspect of the present invention, a system for measuring strokes of CPR is provided. The system may comprise: at least one permanent magnet, placing on reference position(s) of a chest of a patient; and a stroke detecting device, placed on a hand position of a rescuer performing CPR, comprising: a magnetic sensor, measuring magnetic values in a magnetic field formed by the at least one permanent magnet; an accelerometer, measuring acceleration along the direction of stroke with time at where it is located; a CPR detector, working to determine a CPR starting time point; and a controller, signally connected to the magnetic sensor, the CPR detector and the accelerometer, working to record magnetic values from the magnetic sensor and acceleration values from the accelerometer at time points with an equal time interval between any two adjacent time points when CPR is carried out, obtain calibrated velocities of the accelerometer at all time points from the magnetic values and the acceleration values, obtain calibrated positions of the accelerometer at all time points from the magnetic values and the calibrated velocities, and calculate the stroke of CPR at all time points by deducting the calibrated position at the CPR starting time point from all calibrated positions. The permanent magnets are placed with directions of S-pole-to-N-pole reversed spatially.

Preferably, the controller may obtain calibrated velocities of the accelerometer at all time points from the magnetic values and the acceleration values by accumulating products of the acceleration value and the time interval with time to obtain reference velocities at all time points; finding out first time points when relative extrema of the magnetic values happened; finding out first reference velocities at the first time points; processing a statistical analysis on the first reference velocities to obtain a velocity offset for each reference velocity; and deducting the velocity offset from corresponding reference velocity to obtain a calibrated velocity of the accelerometer for all time points. The statistical analysis may be a linear regression analysis or a nonlinear regression analysis.

Preferably, the controller may obtain calibrated positions of the accelerometer at all time points from the magnetic values and the calibrated velocities by accumulating products of the calibrated velocity and the time interval with time to obtain reference locations at all time points; finding out second time points when an assigned magnetic value was approached or happened; finding out first reference locations at the second time points; processing a statistical analysis on the first reference locations to obtain a location offset for each reference location; and deducting the location offset from corresponding reference location to obtain a calibrated position of the accelerometer for all time points. The statistical analysis may be a linear regression analysis or a nonlinear regression analysis.

In one embodiment, the controller may further work to pair each magnetic value with one corresponding calibrated position at the same time point, process a statistical analysis on the pairs to obtain a regression relationship between the magnetic values and the calibrated positions; and replace the calibrated positions with the ones from the regression relationship by inputting the magnetic values for the same time point. The statistical analysis may be a linear regression analysis or a nonlinear regression analysis.

Preferably, the at least permanent magnet may be thin powerful magnets. The thin powerful magnet may be a neodymium magnet or an electromagnet. If there are two permanent magnets is used, they may be placed on the reference positions with the direction of S-pole-to-N-pole is substantially perpendicular to the surface of the chest of the patient.

The present invention takes advantages of changes of magnetic values when the rescuer performs CPR to calculate a real stroke for each movement of CPR. Since the devices the system employs are tiny, the patient under CPR won't be hurt or feel uncomfortable while the rescuer knows if the CPR is done correctly.

DETAILED DESCRIPTION OF THE PREFERRED EMBODIMENTS

The present invention will now be described more specifically with reference to the following embodiments.

Figure 1:
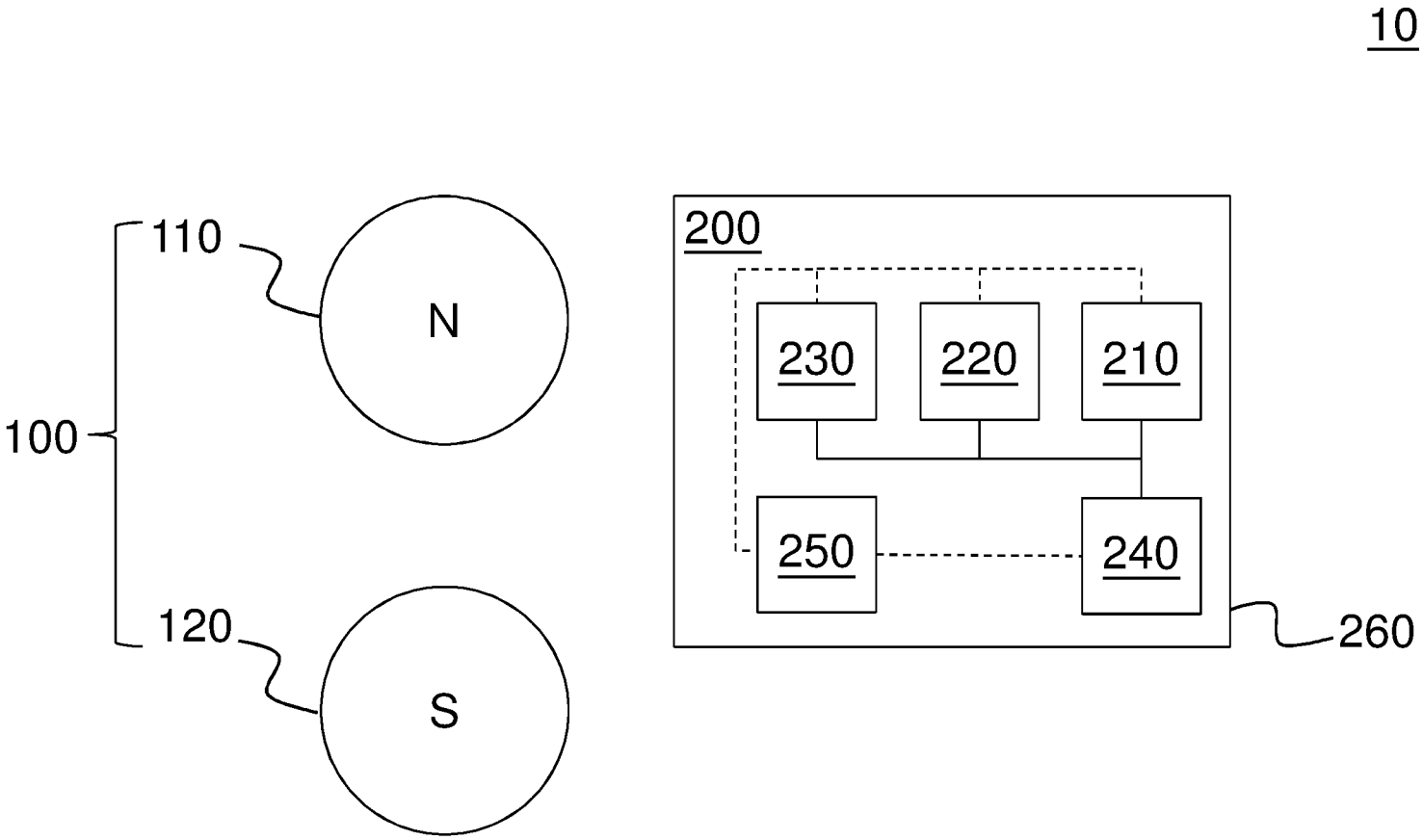
FIG. 1 is a schematic diagram of a system for measuring strokes of CPR in an embodiment according to the present invention.

Please refer to FIG. 1. FIG. 1 shows a schematic diagram of a system 10 for measuring strokes of CPR in an embodiment according to the present invention. The system 10 includes at least one permanent magnet 100. In this embodiment, a pair of permanent magnets 100 (a first permanent magnet 110 and a second permanent magnet 120) are used. The system 10 also includes a stroke detecting device 200. The stroke detecting device 200 further includes a magnetic sensor 210, an accelerometer 220, a CPR detector 230, a controller 240, a power unit 250 and a housing 260. Materials, functions and connections of above elements and a method for measuring strokes of CPR using the system 10 will be illustrated in detail with associated drawings below.

The pair of permanent magnets 100 are used to be placed on two reference positions of a chest of a patient. The reference positions may be any place on the chest of the patient except where CPR is processed. Similarly, if only one permanent magnet 100 is used, it can be placed on any place on the chest of the patient except where CPR is processed. According to the present invention, the permanent magnets 100 are thin powerful magnets. In practice, the thin powerful magnet is a neodymium magnet or an electromagnet. Please see FIG. 2. It is an external side view of the system 10, including the first permanent magnet 110 and the second permanent magnet 120, placing on the chest of a patient under CPR. The permanent magnets 100 are placed on the reference positions with the direction of S-pole-to-N-pole is substantially perpendicular to the surface of the chest of the patient. Since the first permanent magnet 110 is placed with N-pole toward the direction out of the chest and the second permanent magnet 120 is placed with S-pole toward the direction out of the chest, namely, the permanent magnets 100 are placed with directions of S-pole-to-N-pole reversed spatially, the stroke detecting device 200 located around the permanent magnets 100 can detect magnetic values and changes of the magnetic values with the stroke detecting device 200 varying its location when CPR.

Figure 2:
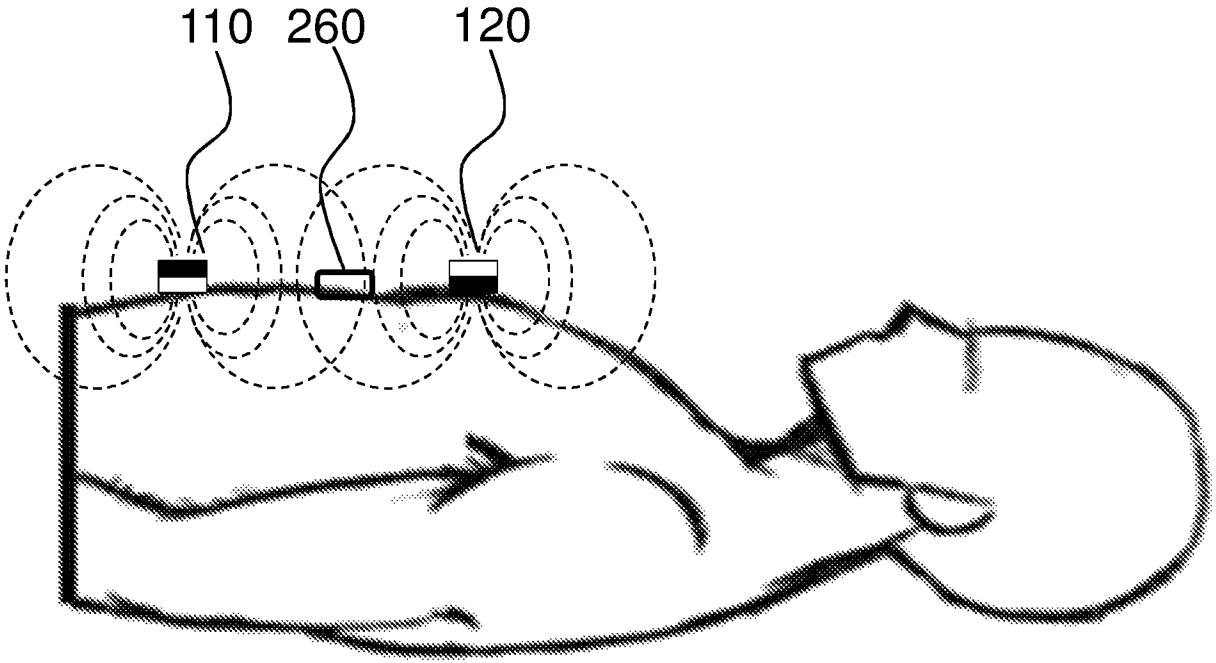
FIG. 2 is an external side view of the system placing on the chest of a patient under CPR.

According to the present invention, the stroke detecting device 200 is placed on where CPR is processed by a rescuer's hands as shown in FIG. 2. It may be mounted on a hand position of the rescuer for performing CPR. The stroke detecting device 200 may include a wristband (not shown) to attach to the hand of the rescuer. The magnetic sensor 210 measures the magnetic values in a magnetic field formed by the permanent magnets 100. During CPR, the magnetic values are linearly varying with the stroke or follows a specific pattern (non-linear) while the bias caused by the movement of the permanent magnets 100 can be calibrated by the data from the accelerometer 220. In this embodiment, the magnetic sensor 210 is enclosed by the housing 260. Thus, once the housing 260 is placed on the chest, the magnetic sensor 210 finishes setup for further recording of received data.

The CPR detector 230 plays a role to determine when to start measuring the strokes of CPR. Namely, it works to determine a CPR starting time point. The CPR starting time point will be used by the controller 240 for further calculations. Here, the CPR starting time point may be the time a rescuer presses his hands toward to the heart of a patient. It may be any moment during CPR as long as the chest of the patient is under a normal condition without external force or additional rebounce due to CPR. In this embodiment, the CPR detector 230 is an independent circuitry to receive a decided message from users. In another embodiment, functions of the CPR detector 230 can be implemented by the magnetic sensor 210 or the controller 240. It should be noticed that the CPR starting time point determines a position of the accelerometer 220 to zero so that any other calculated position of the accelerometer 220 can be transferred to an absolute position and a real stroke of CPR is available.

The accelerometer 220 is configured in the stroke detecting device 200, too. Any accelerometer, e. g. g-sensor, is able to detect accelerations in all direction. In this invention, the accelerometer 220 is requested to measure the acceleration along the direction of stroke with time (sequentially) at where it is located. Theoretically, movements of hands of the rescuer should follow the same direction. The accelerometer 220 excluding acceleration components perpendicular to the gravity direction help capture the movements more precisely.

The controller 240 is the role to obtain the strokes of CPR by collecting data from the magnetic sensor 210 and the accelerometer 220, and process associated calculations. It is signally connected to the magnetic sensor 210, the accelerometer 220 and the CPR detector 230. The controller 240 works to record magnetic values from the magnetic sensor 210 and acceleration values from the accelerometer 220 at time points (the time points are sequential on the timeline; any two adjacent time points has an equal time interval therebetween) when CPR is carried out, obtain calibrated velocities of the accelerometer 220 at all time points from the magnetic values and the acceleration values, obtain calibrated positions of the accelerometer 220 at all time points from the magnetic values and the calibrated velocities, and calculate the stroke of CPR at all time points by deducting the calibrated position at the CPR starting time point from all calibrated positions. Here, a working principle of the system 10 should be introduced along with that of the controller 240.

If the permanent magnets 100 on reference positions don't change their elevations when CPR is processed, a locating point of the stroke detecting device 200 can be available and the position of the hands of the rescuer can be simply calculating with magnetic values only (in order to differentiate measurements from calculations, all data collected by measuring are named after a "value" in the end while data calculated are not limited this way). However, the environment (chest) where CPR is processed is elastic. When one stroke of CPR is carried out, the chest profile changes. The stroke detecting device 200 and the permanent magnets 100 all sink but with different levels. At this moment, the accelerometer 220 moves along with the stroke detecting device 200. A relative reference position of the accelerometer 220 can be obtained by integrating the acceleration values with time twice. However, due to characteristics of electronic components, offsets come out and the calculated positions intend to diverse. Meanwhile, the gearing of the reference object 100 is further interfered by the changeable chest. It is lucky that there is a relationship between the magnetic values from the magnetic sensor 210 and acceleration values from the accelerometer 220 although it might be linear or non-linear. The controller 240 is set to figure out such relationship, calculate the relative reference positions, and calibrate the relative reference positions to have real positions.

In order to obtains calibrated velocities of the accelerometer 220 at all time points from the magnetic values and the acceleration values, the controller 240 accumulates products of the acceleration value and the time interval with time to obtain reference velocities at all time points, finds out first time points when relative extrema of the magnetic values happened, finds out first reference velocities at the first time points, processes a statistical analysis on the first reference velocities to obtain a velocity offset for each reference velocity, and deducting the velocity offset from corresponding reference velocity to obtain a calibrated velocity of the accelerometer 220 for all time points. Details of operating these functions will be illustrated in a method for measuring strokes of CPR using the system 10. The statistical analysis here may be a linear regression analysis or a nonlinear regression analysis based on which one fits the hardware of the system 10.

In order to obtain calibrated positions of the accelerometer 220 at all time points from the magnetic values and the calibrated velocities, the controller 240 accumulates products of the calibrated velocity and the time interval with time to obtain reference locations at all time points, finds out second time points when an assigned magnetic value was approached or happened, finds out first reference locations at the second time points, processes a statistical analysis on the first reference locations to obtain a location offset for each reference position, and deducts the location offset from corresponding reference location to obtain a calibrated position of the accelerometer 220 for all time points. Details of operating these functions will be illustrated in the method for measuring strokes of CPR using the system 10. Similarly, the statistical analysis here may be a linear regression analysis or a nonlinear regression analysis based on which one fits the hardware of the system 10.

In order to get real-time information, the controller 240 can further work to pair each magnetic value with one corresponding calibrated position at the same time point, process a statistical analysis on the pairs to obtain a regression relationship between the magnetic values and the calibrated positions; and replace the calibrated positions with the ones from the regression relationship by inputting the magnetic values for the same time point. Details of operating these functions will be illustrated in the method for measuring strokes of CPR using the system 10. Similarly, the statistical analysis here may be a linear regression analysis or a nonlinear regression analysis based on which one fits the hardware of the system 10.

The power unit 250 in this embodiment is a primary battery, e.g. a mercury battery. In other embodiments, the power unit 250 may be a secondary battery, e.g. a lithium battery. The power unit 250 is used to provide power to the CPR detector 230, the magnetic sensor 210, the accelerometer 220, and the controller 240 for operation. The housing 260 encloses the magnetic sensor 210, the accelerometer 220, the CPR detector 230, the controller 240 and the power unit 250. The housing 260 may be made of metal, plastic, rubber or even natural materials, e.g. wood.

Figure 3:
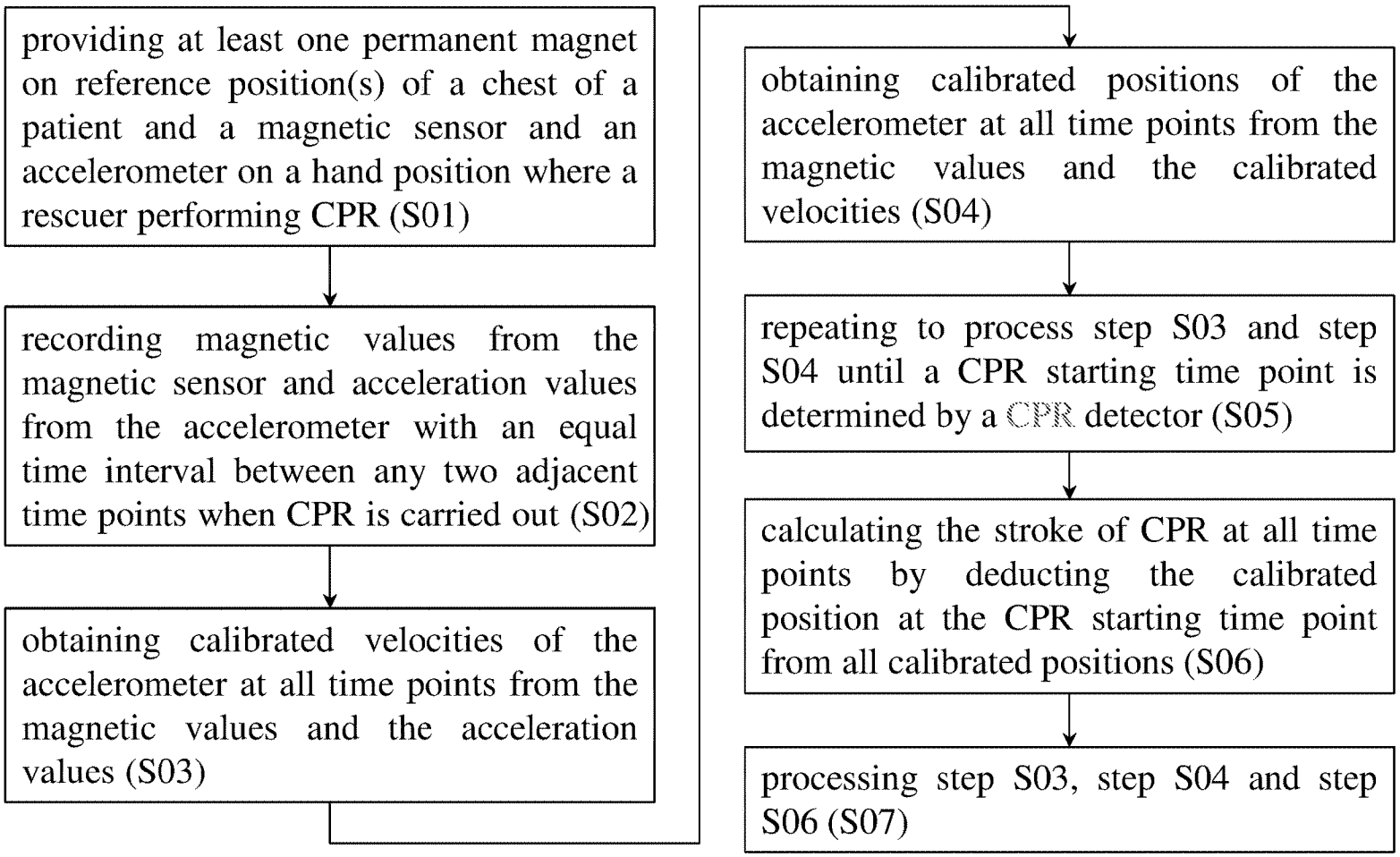
FIG. 3 is a flow chart of a method for measuring strokes of CPR using the system.

The present invention also discloses a method for measuring strokes of CPR using the system 10. Please refer to FIG. 3. It is a flow chart of the method. The first step of the method is providing at least one permanent magnet 100 on reference position(s) of a chest of a patient and a magnetic sensor 210 and an accelerometer 220 on a hand position where a rescuer performing CPR (S01). Next, record magnetic values from the magnetic sensor 210 and acceleration values from the accelerometer 220 with an equal time interval between any two adjacent time points when CPR is carried out (S02). It should be noticed that no matter what the magnetic value or the acceleration value is, they are converted from a voltage or a set of bits sent from the magnetic sensor 210 or the accelerometer 220. A conversion factor is used to operate with the voltage or the set of bits represent to obtain a useful value.

Figure 4:
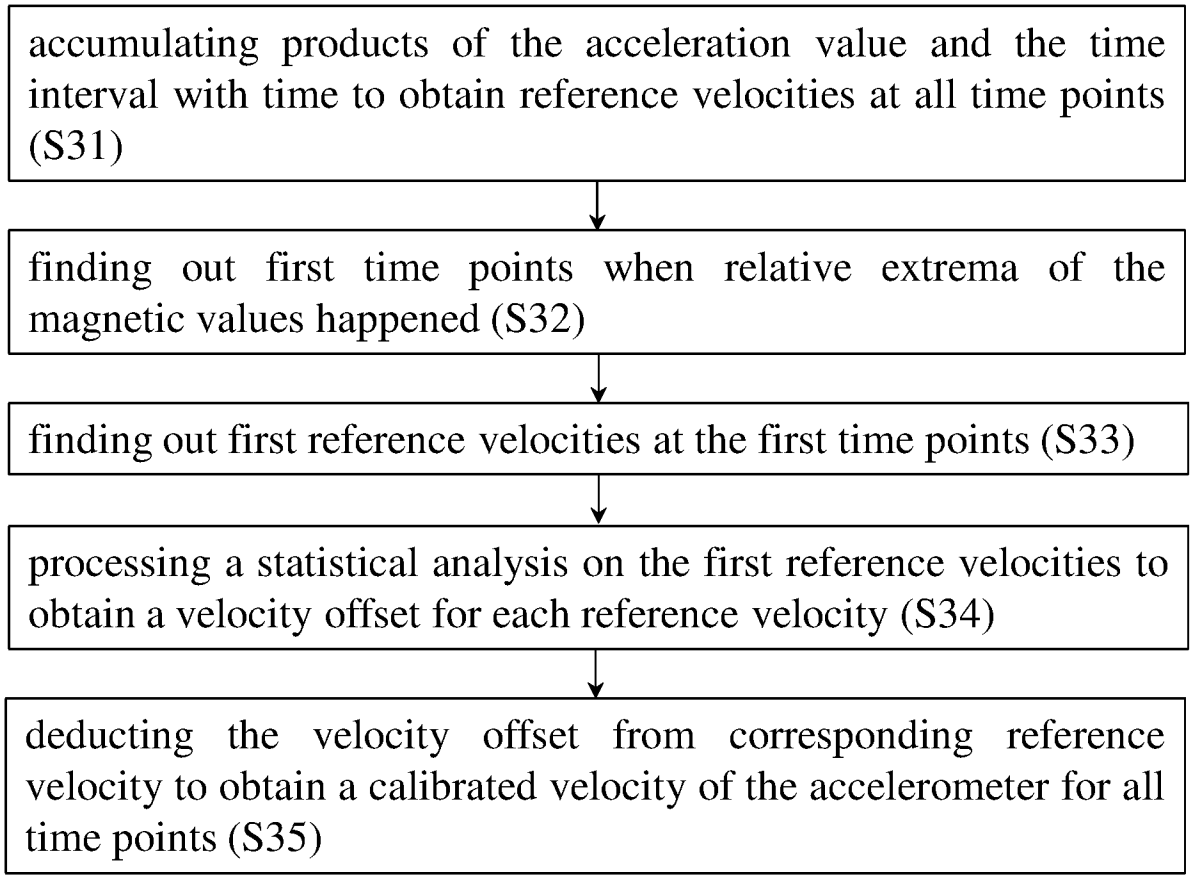
FIG. 4 shows sub-steps of step S03 of the method.
Figure 5:
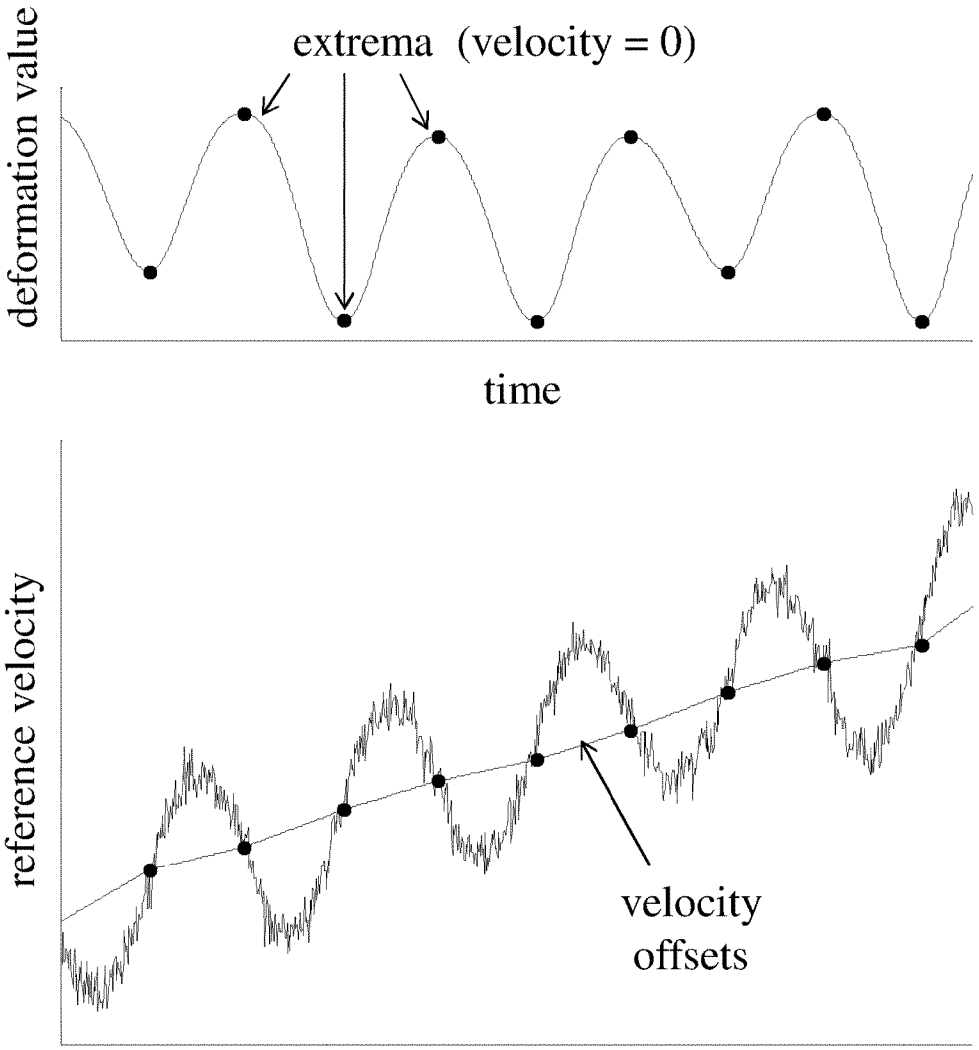
FIG. 5 shows two diagrams for comparison.

A third step is obtaining calibrated velocities of the accelerometer at all time points from the magnetic values and the acceleration values (S03). Since step S03 may be repeated many times, all time points refer to the time points happen in one operation of step S03. Hereinafter, a time point mentioned in any step refers to the time point happens in corresponding operation of that step. Step S03 can be further achieved by the sub-steps. In order to have a better understanding, please see FIG. 4. It shows sub-steps of step S03. A first sub-step is accumulating products of the acceleration value and the time interval with time to obtain reference velocities at all time points (S31). This is an implementation of integral of measured acceleration value with time. Integral of accelerations is changes of velocity. Since in the beginning of recording, the accelerometer 220 may be at velocity of zero or a preset value, relative velocity at any time points can be calculated. Then, find out first time points when relative extrema of the magnetic values happened (S32). In order to have clear view of how step S32 works, please refer to FIG. 5. It shows two diagrams for comparison. The upper diagram illustrates how magnetic values change with time. The lower one illustrates reference velocities in all time points and is obtained by integral of accelerations. In the upper diagram, circle points point out the relative extrema of the magnetic values. The time points correspond to the circle points are the first time points. Next, find out first reference velocities at the first time points (S33). The time lines of the upper diagram or the lower diagram are synchronous. Hence, the first reference velocities can be found when the first time points are determined. A fourth sub-step is processing a statistical analysis on the first reference velocities to obtain a velocity offset for each reference velocity (S34). As shown in FIG. 5, velocity offsets exist in each first reference velocity. If reliable calculated velocities are desired, the velocity offsets must be eliminated. However, increment of the velocity offset for every time point may not the same. In order to simplify calculation, the velocity offsets should be obtained statistically. The statistical analysis, as mentioned above, can be a linear regression analysis or a nonlinear regression analysis. Last, deduct the velocity offset from corresponding reference velocity to obtain a calibrated velocity of the accelerometer for all time points (S35). Thus, all reference velocities are shifted down to get the calibrated velocities.

Figure 6:
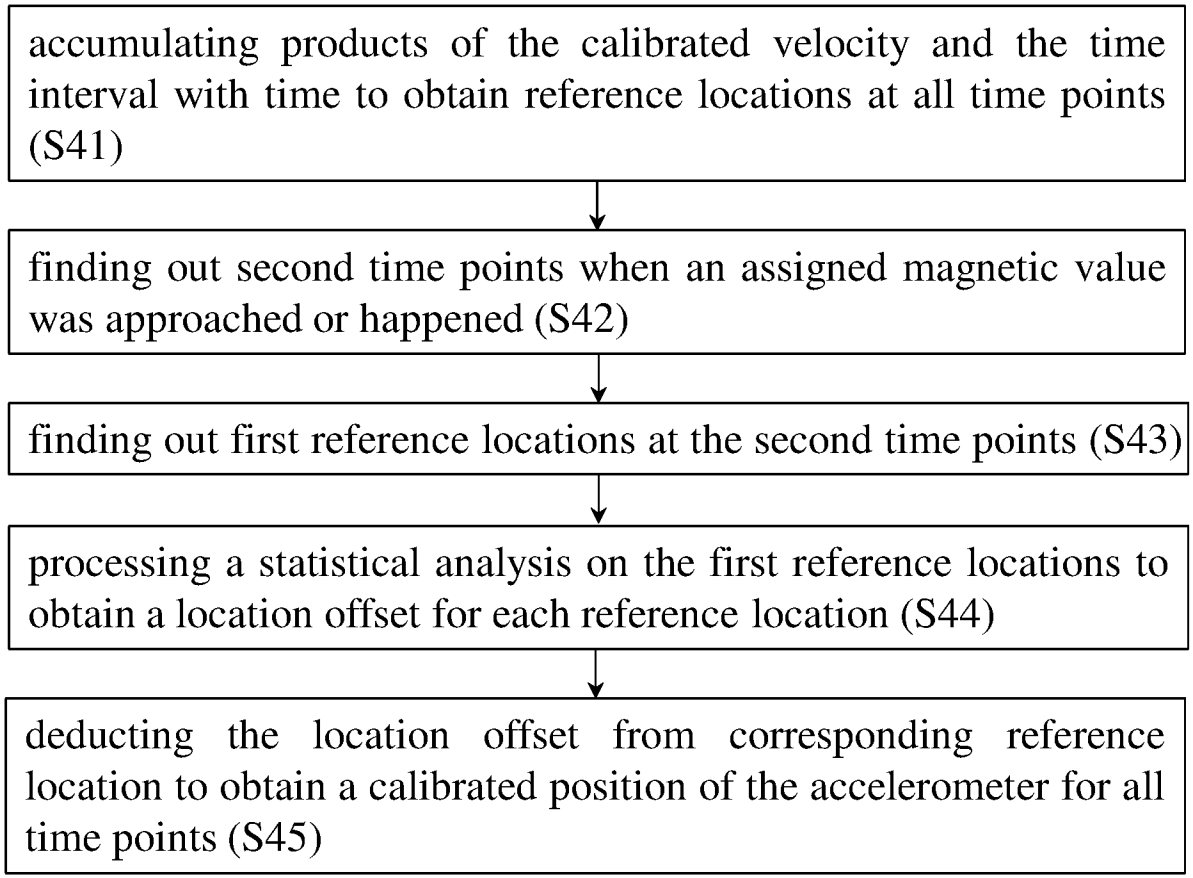
FIG. 6 shows sub-steps of step S04 of the method.
Figure 7:
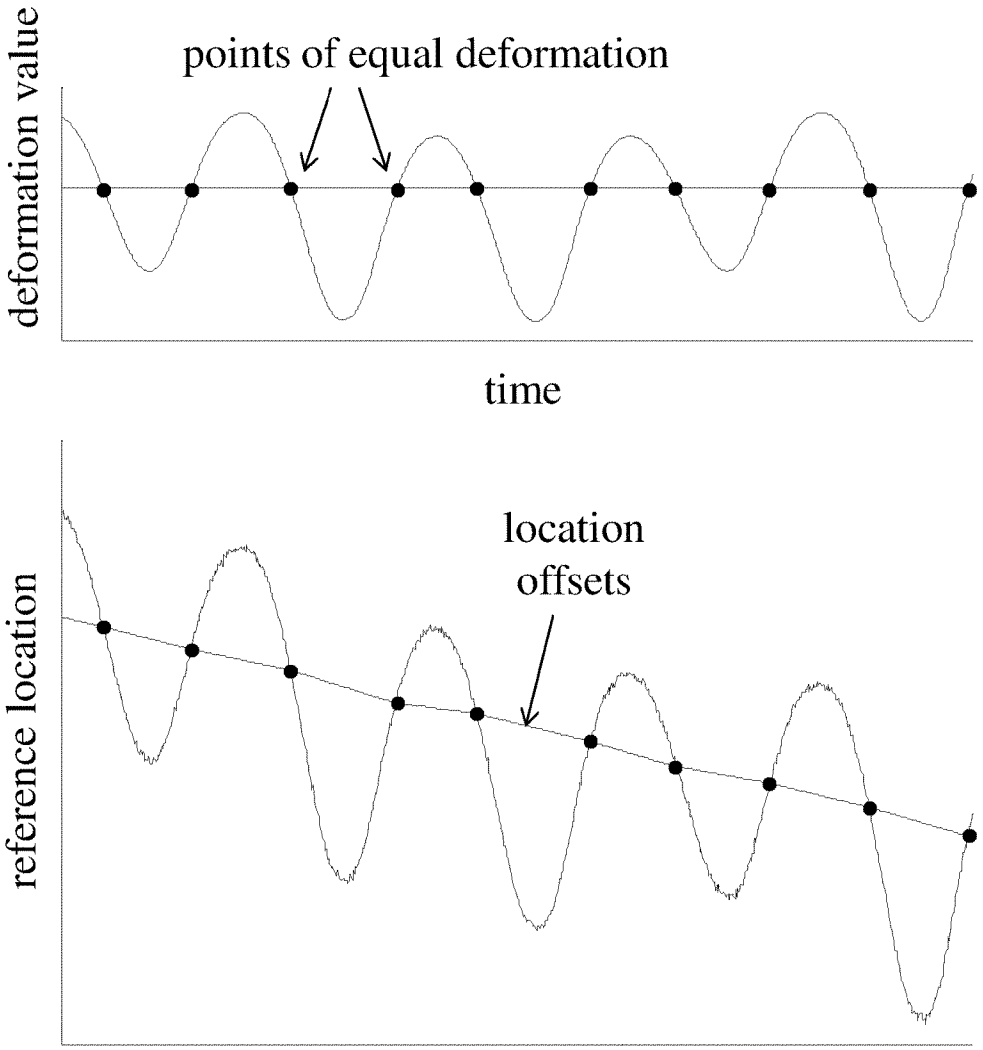
FIG. 7 shows two diagrams for comparison.

A fourth step of the method is obtaining calibrated positions of the accelerometer at all time points from the magnetic values and the calibrated velocities (S04). Similarly, it can be further achieved by the sub-steps. Please refer to FIG. 6. It shows sub-steps of step S04 of the method. A first sub-step is accumulating products of the calibrated velocity and the time interval with time to obtain reference locations at all time points (S41). This is an implementation of integral of calculated calibrated velocity with time. Integral of velocities is location. Since in the beginning of calculation, the accelerometer 220 may locates at any position of the stoke of CPR (preferably, a neutral position without movement of the chest), relative locations at any time points can be calculated. Then, finding out second time points when an assigned magnetic value was approached or happened (S42). In order to have clear view of how step S42 works, please refer to FIG. 7. It shows two diagrams for comparison. The upper diagram still illustrates how magnetic values change with time. The lower one illustrates reference locations in all time points and is obtained by integral of velocities. In the upper diagram, circle points point out the assigned magnetic value on the curve. In practice, the magnetic value may not meet the assigned magnetic value in one stroke of CPR due to time points to collect data, so a closest magnetic value to the assigned magnetic value in one CPR can be used as an alternative value. The time points correspond to the circle points are the second time points. Next, find out first reference locations at the second time points (S43). The time lines of the upper diagram or the lower diagram are synchronous. Hence, the first reference locations can be found when the second time points are determined. A fourth sub-step is processing a statistical analysis on the first reference locations to obtain a location offset for each reference location (S44). As shown in FIG. 7, location offsets exist in each first reference location. If reliable calculated locations are desired, the location offsets must be eliminated. However, increment of the location offset for every time point may not the same. In order to simplify calculation, the location offsets should be obtained statistically. Similarly, the statistical analysis can be a linear regression analysis or a nonlinear regression analysis. Last, deduct the location offset from corresponding reference location to obtain a calibrated position of the accelerometer for all time points (S45). Thus, all reference locations are shifted up to get the calibrated positions.

A fifth step of the method is repeating to process step S03 and step S04 until a CPR starting time point is determined by the CPR detector 230 (S05). CPR detector 230 may be achieved by set up thresholds and check if the static properties of magnetic values and acceleration value exceeding the thresholds. As mentioned above, once the CPR starting time point is determined, a CPR starting position can be determined. Then, calculate the stroke of CPR at all time points by deducting the calibrated position at the CPR starting time point from all calibrated positions (S06). Finally, as the CPR starting time point is determined and CPR continues, it only needs to process step S03, step S04 and step S06 (S07).

Figure 8:
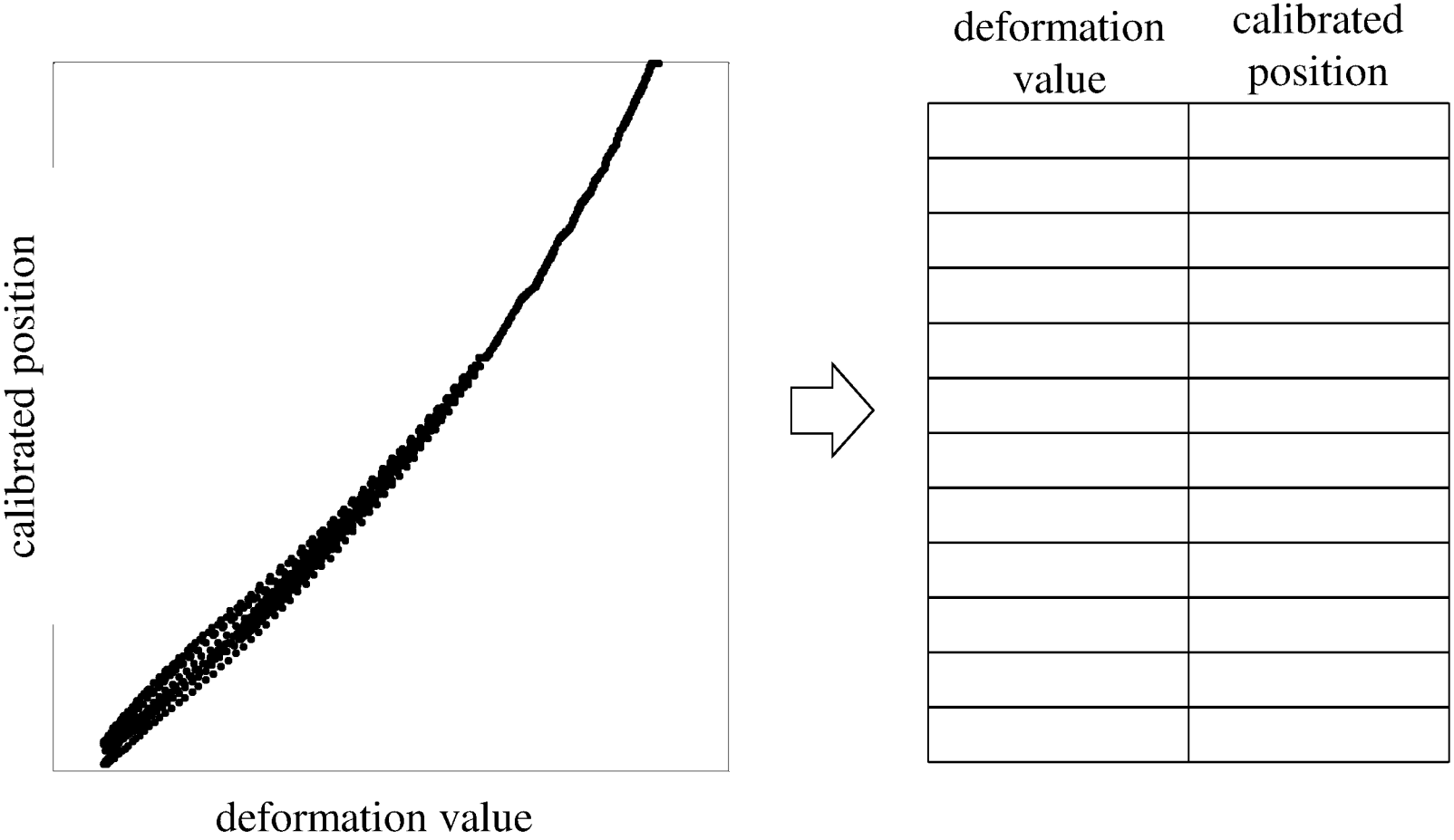
FIG. 8 shows how a regression relationship is found.

According to the present invention, in order to have real-time positions of the strokes of CPR, the method can have further steps between step S04 and step S05. The further steps are pairing each magnetic value with one corresponding calibrated position at the same time point (S46); processing a statistical analysis on the pairs to obtain a regression relationship between the magnetic values and the calibrated positions (S47); and replacing the calibrated positions with the ones from the regression relationship by inputting the magnetic values for the same time point (S48). An exemplary figure can be used to illustrate the three extra steps. Please see FIG. 8. On the right, the magnetic values and the calibrated positions are paired in two columns. On the left, the magnetic values and the calibrated positions are plotted on the X-axis and Y-axis, respectively. It is done when step S46 completes. Then, step S47 use the left diagram to calculate the regression relationship. Since the regression relationship may be linear or non-linear, the statistical analysis applied may be a linear regression analysis or a nonlinear regression analysis. Finally, step S48 uses the regression relationship to provide new calibrated positions. In short, after a period of data collecting, once a magnetic value (deformation of the reference object 100) is available, the stoke of CPR can be available, too.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A method for measuring strokes of Cardiopulmonary Resuscitation (CPR), comprising the steps of:

a) providing at least one permanent magnet on reference position(s) of a chest of a patient and a magnetic sensor and an accelerometer on a hand position where a rescuer performing CPR, wherein the magnetic sensor measures magnetic values in a magnetic field formed by the at least one permanent magnet, and the accelerometer measures acceleration along the direction of stroke with time at where it is located;

b) recording magnetic values from the magnetic sensor and acceleration values from the accelerometer with an equal time interval between any two adjacent time points when CPR is carried out;

c) obtaining calibrated velocities of the accelerometer at all time points from the magnetic values and the acceleration values;

d) obtaining calibrated positions of the accelerometer at all time points from the magnetic values and the calibrated velocities;

e) repeating to process step c) and step d) until a CPR starting time point is determined by a CPR detector;

f) calculating the stroke of CPR at all time points by deducting the calibrated position at the CPR starting time point from all calibrated positions; and g) processing step c), step d) and step f).

2. The method according to claim 1, wherein the step c) is achieved by the sub-steps of:

c1) accumulating products of the acceleration value and the time interval with time to obtain reference velocities at all time points;

c2) finding out first time points when relative extrema of the magnetic values happened;

c3) finding out first reference velocities at the first time points;

c4) processing a statistical analysis on the first reference velocities to obtain a velocity offset for each reference velocity; and c5) deducting the velocity offset from corresponding reference velocity to obtain a calibrated velocity of the accelerometer for all time points.

3. The method according to claim 2, wherein the statistical analysis is a linear regression analysis or a nonlinear regression analysis.

4. The method according to claim 1, wherein the step d) is achieved by the sub-steps of:

d1) accumulating products of the calibrated velocity and the time interval with time to obtain reference locations at all time points;

d2) finding out second time points when an assigned magnetic value was approached or happened;

d3) finding out first reference locations at the second time points;

d4) processing a statistical analysis on the first reference locations to obtain a location offset for each reference location; and d5) deducting the location offset from corresponding reference location to obtain a calibrated position of the accelerometer for all time points.

5. The method according to claim 4, wherein the statistical analysis is a linear regression analysis or a nonlinear regression analysis.

6. The method according to claim 1, further comprising steps between the step d) and the step e):

d6) pairing each magnetic value with one corresponding calibrated position at the same time point;

d7) processing a statistical analysis on the pairs to obtain a regression relationship between the magnetic values and the calibrated positions; and d8) replacing the calibrated positions with the ones from the regression relationship by inputting the magnetic values for the same time point.

7. The method according to claim 6, wherein the statistical analysis is a linear regression analysis or a nonlinear regression analysis.

8. The method according to claim 1, wherein the at least one permanent magnet is a thin powerful magnet.

9. The method according to claim 8, wherein the thin powerful magnet is a neodymium magnet or an electromagnet.

10. A system for measuring strokes of CPR, comprising: at least two permanent magnets, for placing on reference position(s) of a chest of a patient; and a stroke detecting device, placed on a hand position of a rescuer performing CPR, comprising: a magnetic sensor, measuring magnetic values in a magnetic field formed by the at least one permanent magnet; an accelerometer, measuring acceleration along the direction of stroke with time at where it is located; a CPR detector, working to determine a CPR starting time point; and a controller, signally connected to the magnetic sensor, the CPR detector and the accelerometer, working to record magnetic values from the magnetic sensor and acceleration values from the accelerometer at time points with an equal time interval between any two adjacent time points when CPR is carried out, obtain calibrated velocities of the accelerometer at all time points from the magnetic values and the acceleration values, obtain calibrated positions of the accelerometer at all time points from the magnetic values and the calibrated velocities, and calculate the stroke of CPR at all time points by deducting the calibrated position at the CPR starting time point from all calibrated positions, wherein a first of the at least two permanent magnets is placed with a direction of S-pole-to-N-pole, and a second magnet of the at least two magnets is placed spatially relative to the first magnet with a direction of N-pole-to-S-pole.

11. The device according to claim 10, wherein the controller obtains calibrated velocities of the accelerometer at all time points from the magnetic values and the acceleration values by accumulating products of the acceleration value and the time interval with time to obtain reference velocities at all time points; finding out first time points when relative extrema of the magnetic values happened; finding out first reference velocities at the first time points; processing a statistical analysis on the first reference velocities to obtain a velocity offset for each reference velocity; and deducting the velocity offset from corresponding reference velocity to obtain a calibrated velocity of the accelerometer for all time points.

12. The device according to claim 11, wherein the statistical analysis is a linear regression analysis or a nonlinear regression analysis.

13. The device according to claim 10, wherein the controller obtains calibrated positions of the accelerometer at all time points from the magnetic values and the calibrated velocities by accumulating products of the calibrated velocity and the time interval with time to obtain reference locations at all time points; finding out second time points when an assigned magnetic value was approached or happened; finding out first reference locations at the second time points; processing a statistical analysis on the first reference locations to obtain a location offset for each reference location; and deducting the location offset from corresponding reference location to obtain a calibrated position of the accelerometer for all time points.

14. The device according to claim 13, wherein the statistical analysis is a linear regression analysis or a nonlinear regression analysis.

15. The device according to claim 10, wherein the controller further works to pair each magnetic value with one corresponding calibrated position at the same time point, process a statistical analysis on the pairs to obtain a regression relationship between the magnetic values and the calibrated positions; and replace the calibrated positions with the ones from the regression relationship by inputting the magnetic values for the same time point.

16. The device according to claim 15, wherein the statistical analysis is a linear regression analysis or a nonlinear regression analysis.

17. The device according to claim 10, wherein the at least one permanent magnet is a thin powerful magnet.

18. The device according to claim 17, wherein the thin powerful magnet is a neodymium magnet or an electromagnet.

* * * * *